United States Patent [19]

Bishop et al.

[11] 4,456,215

[45] Jun. 26, 1984

[54] INNER SEAL AND SUPPORT ROD ASSEMBLY FOR HIGH PRESSURE BLOWOUT PREVENTERS

[75] Inventors: Thomas R. Bishop; Arnal B. Foreman, Jr., both of Houston, Tex.

[73] Assignee: Bowen Tools, Inc., Houston, Tex.

[21] Appl. No.: 375,961

[22] Filed: May 7, 1982

[51] Int. Cl.[3] ..... E21B 33/06

[52] U.S. Cl. ..... 251/1 B; 251/1 A; 277/31; 277/228

[58] Field of Search ..... 251/1 A, 1 B, 1 R; 277/31, 33, 35, 228

[56] References Cited

U.S. PATENT DOCUMENTS 1,963,683 6/1934 Shaffer ..... 251/1 A
3,208,357 9/1965 Allen et al. ..... 251/1 A
3,939,903 2/1976 Sakaki et al. ..... 277/228

OTHER PUBLICATIONS

Dec. 1981 Instruction Manual No. 5/8523 of Bowen Tools, Inc.

*Primary Examiner*—Martin P. Schwadron
*Assistant Examiner*—Sheri Novack
*Attorney, Agent, or Firm*—Pravel, Gambrell, Hewitt, Kirk & Kimball

[57] ABSTRACT

A new and improved inner seal and support rod assembly for a blowout preventer including an inner seal assembly for improved sealing and configured to promote ease of maintenance and removal thereof in cooperation with substantially horizontally disposed, vertically aligned support rods of the blowout preventer.

13 Claims, 8 Drawing Figures

INNER SEAL AND SUPPORT ROD ASSEMBLY FOR HIGH PRESSURE BLOWOUT PREVENTERS

TECHNICAL FIELD OF THE INVENTION

The field of this invention relates to blowout preventers, and more particularly to inner seal and support rod assemblies thereof.

PRIOR ART

Blowout preventers of many types and configurations are well known in the art. In the prior art, it is not unusual that an inner seal be mounted with a ram body used to close the annulus within the blowout preventer during typical operations thereof. So far as known, prior art inner seal arrangements have included many types of sealing materials. Most notably, such seals have been a combination of sandwiched materials with a metal upper and lower member being secured with a resilient sealing material and typically of a substantially rectangular cross-sectional configuration. The upper and lower metal members are conventionally bonded with the resilient sealing material. Furthermore, it is known that the resilient material preferably be in full face engagement with the ram body to enhance a sealing relationship between the inner seal/ram body and tubular member to be sealed off upon actuation of the blowout preventer.

The prior art also teaches the use of pins or fasteners extending through the ram body into the inner seal for locating the inner seal with the ram body. Examples of such an arrangement are shown in the December 1981 instruction manual No. 5/8523 of Bowen Tools, Inc., entitled "Bowen Snubbing Blowout Preventers". Typically, a substantially rectangular opening is formed in the ram body to receive the inner seal assembly and the inner seal is typically appropriately positioned and secured with the ram body by means of retainer screws, pins and the like to ensure proper location and orientation of the inner seal with respect to the ram body. Furthermore, as is known, the ram body is mountable within a suitable preventer housing, with a pressure plate assembly with the preventer housing enclosing and permitting actuation of the ram of the blowout preventer. Removal of the pressure plate permits access to the ram body for maintenance of the ram body and its attendant seals. It is also shown in the aforementioned Bowen manual, that typically suitable support rods are mounted with the preventer housing and pressure plate to permit retraction of the pressure plate to expose the ram body for seal replacement. In the prior art it is known that such support rods, so far as known, have been mounted with the preventer body in the same horizontal plane as that of the ram body. As such, upon retraction of the pressure plate, the removal of the inner seal for replacement becomes a difficult maintenance item particularly in view of typical stack arrangements of blowout preventers, as shown schematically on page 13 of the Bowen manual. As such, access to the ram body is restrained and removal of the inner seal assembly is sometimes difficult if not impossible without requiring significant effort in order to effectuate seal maintenance and removal.

SUMMARY OF THE INVENTION

The present invention relates to an new and improved inner seal and rod assembly for a blowout preventer that enhances inner seal effectiveness while providing a seal that is easily removed from the ram body for maintenance. A feature of the present invention includes vertically oriented support rods that permit the lateral extraction of the inner seal assembly from the ram body to enhance seal removal operations.

DESCRIPTION OF THE PREFERRED EMBODIMENT

Figure 1:
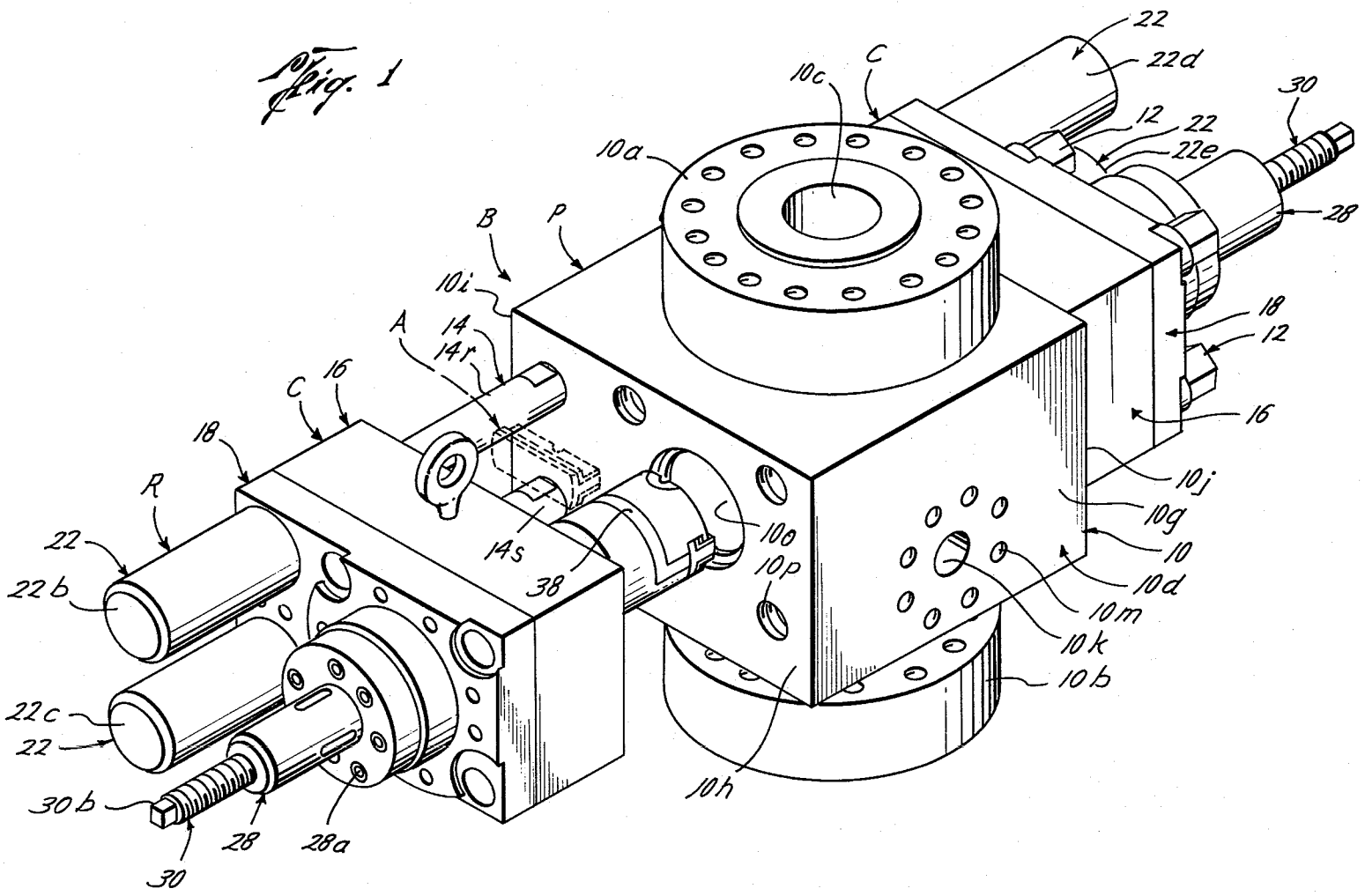
FIG. 1 is an isometric view of a typical snubbing-type blowout preventer, in a partially exploded view, showing the ram body and inner seal assembly of the present invention therewith and further showing the vertical orientation of the horizontally disposed support rods that permit the lateral extraction of the inner seal assembly of the present invention.

Referring to the drawings, the letter A designates generally the inner seal assembly and the letter R refers generally to the support rod assembly of the present invention as adapted to be used in conjunction with a blowout preventer B. The blowout preventer B generally includes a preventer body P that is adapted to receive a ram body D having the inner seal assembly A therewith. A pressure plate C secures the ram body D with the preventer body P. The ram body D is adapted to be supportably mounted by the pressure plate C upon disassembly thereof. Unless otherwise noted, the components of the blowout preventer B are preferably made of suitable high strength materials capable of withstanding the typically high stresses and strains encountered in normal blowout preventer operations.

Figure 5:
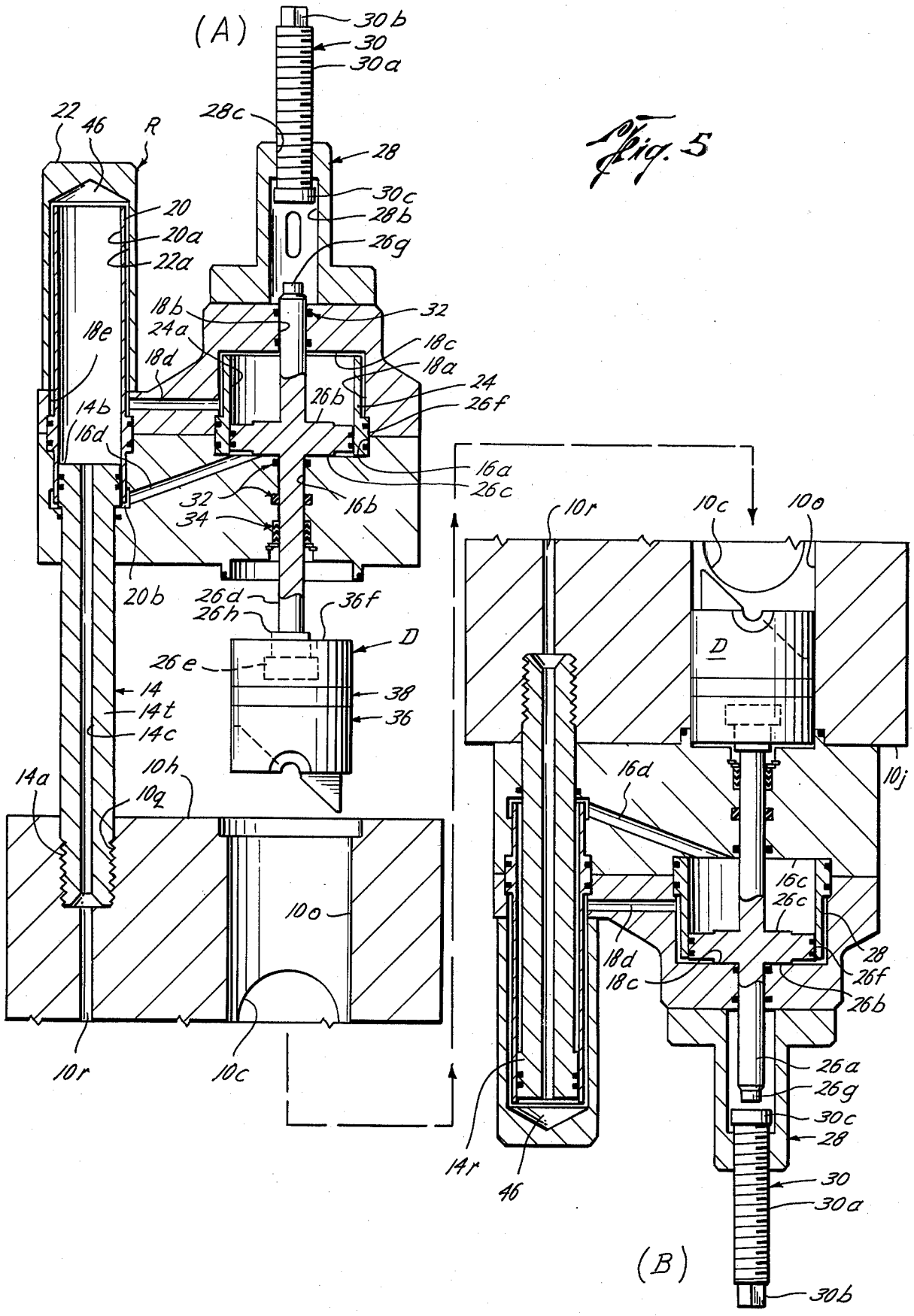
FIG. 5 is a planar, sectional view of the blowout preventer of the present invention, as taken along the lines 5—5 of FIG. 2.

The inner seal assembly A and support rod assembly R of the present invention are adapted to be used with the blowout preventer B. The blowout preventer B includes a preventer body P which includes body 10. The body 10 (FIGS. 1, 2) includes an upper flange **10*a* and lower flange 10*b* for mounting the preventer body P with other blowout preventers or flanged tubular members as is necessary. The body 10 is formed having a substantially vertical central bore 10*c* which is adapted to receive a tubular member (not shown) therein. The upper and lower flanges 10*a*, 10*b* are joined with the central body member 10*d* by body extensions 10*e*, 10*f*, respectively. The central body member 10*d* is formed having body sides 10*g*, 10*h*, 10*i*, 10*j*. Preferably an opening 10*k* is formed with side 10*g* and communicates therefrom to a central bore 10*c*, much as opening 10*l* communicates from side 10*i* to central bore 10*c*. Suitable capping flanges (not shown) are adapted to be secured with sides 10*g*, 10*i* adjacent to openings 10*k***, 10*l*, respectively by means of threaded bolts (not shown) being receivably mounted in threaded openings 10*m*, 10*n*, respectively for appropriately covering the openings 10*k*, 10*l* during blowout preventer operations. The sides 10*h*, 10*j* of the body 10 of the preventer body P communicate by means of a substantially horizontal ram bore 10*o* which extends between such sides 10*h*, 10*j* and intersects the central bore 10*c* of the body 10, as best seen in FIG. 5. A plurality of threaded openings 10*p* are disposed about the ram bore 10*o* and for receiving pressure plate bolts 12, as discussed more fully hereinbelow. It is preferred that the threaded openings 10*p* be in an axially parallel orientation with respect to the ram bore 10*o* and disposed in a substantially square pattern about the ram bore 10*o*. As discussed more fully hereinbelow, the ram body D is adapted to be mounted within the ram bore 10*o* of the body 10. The body 10 is further formed having threaded openings 10*q* (FIG. 5) for receiving piston rod 14. Preferably, the piston rod 14 has a threaded end 14*a* for being received in threaded opening 10*q* of the preventer body P. The piston rod 14 has a piston end 14*b* with a central bore 14*c* extending between the threaded end 14*a* and piston end 14*b*. As will be discussed more fully hereinbelow, preferably there are two piston rods 14 such as rods 14*r*, 14*s* on side 10*h* and two piston rods 14 such as rods 14*t*, 14*u* on side 10*j* of the body 10 of the preventer body P with the rods 14*r*, 14*s* being horizontally opposed and in axial alignment with rods 14*t*, 14*u*, respectively. Preferably the piston rods 14 have the longitudinal axis thereof parallel with that of the ram bore 10*o*, however, are situated in a vertical plane with respect to one another on each side as will be discussed more fully hereinbelow.

The blowout preventer B further includes a pressure plate C including plate 16 and rear body 18. The plate 16 and rear body 18 are adapted to be joined together and receive a suitable piston sleeve 20 therein for receiving piston rod 14 therein. Compatibly formed openings (not numbered) within the plate 16 and 18 permit proper location of the piston sleeve 20 to ensure a fluid tight relation between the piston end 14*b* of the piston rod 14 and the bore 20*a* of the piston sleeve 20. A piston housing 22 is mounted with the rear body 18 to fully enclose the piston sleeve 20 and to provide appropriate fluid communication between the piston sleeve 20, rear body 18 and plate 16. The rear body 18 is formed having a piston sleeve chamber 18*a* therein adjacent to stem lock opening 18*b*. A compatibly formed piston sleeve chamber 16*a* is formed in plate 16 of the pressure plate C having a rod opening 16*b* formed adjacent thereto. A piston sleeve 24 is adapted to be sealably disposed within the piston sleeve chamber 16*a*, 18*a* of the plate 16 and rear body 18, respectively. A pair of horizontally opposed, axially aligned actuating rods 26 are used with the blowout preventer B. Each actuating rod 26 has a stem 26*a*, piston surfaces 26*b*, 26*c*, rod 26*d* and ram body head 26*e* is mounted with the rear body 18 and plate 16 such that the stem 26*a* is mountable within stem lock opening 18*b*. Piston surfaces 26*b*, 26*c* having annular piston surface 26*f* therebetween, are disposed within the bore 24*a* of the piston sleeve 24, with rod 26*d* disposed within rod opening 16*b* and extending from rod opening 16*b* into the body 10, with the ram body head 26*e* adapted to engage the ram body D.

A suitable stem cap 28 is secured with the rear body 18 by stem cap fasteners 28*a*. The stem cap 28 is preferably formed having a chamber 28*b* therein and adapted to receive the stem 26*a* of the actuating rod 26. The step cap 28 is further formed having a threaded opening 28*c* adjacent the chamber 28*b* for receiving stem lock 30. The stem lock 30 is preferably formed having threads 30*a* on the exterior thereof and adapted to be compatibly received within threaded opening 28*c* of stem cap 28. A tool engaging surface 30*b* is formed adjacent one end thereof while a stem receiver 30*c* is formed adjacent the opposite end thereof. The stem receiver 30*c* of the stem lock 30 is adapted to engage the stem end 26*g* of the stem 26*a* under conditions described more fully hereinbelow. Suitable seal means 32 and packing means 34 insure proper sealable action between the actuating rod 26 and the rear body 18 and plate 16.

The actuating rod 26 is movable between an actuated position (as shown in FIG. 5A) and a retracted (as shown in FIG. 5B). When the actuating rod 26 is in the actuated position of FIG. 5A, piston surface 26*c* is adjacent to the end surface 16*c* of piston sleeve chamber 16*a* of plate 16, with the stem end 26*g* of the actuating rod 26 near opening 18*b* of the rear body 18, while ram body head 26*e* of the actuating rod 26 is adapted to extend into the preventer body P with the ram body B. On the other hand, when the actuating rod is in a retracted position as shown in FIG. 5B, piston surface 26*b* is adapted to be adjacent to end surface 18*c* of piston sleeve chamber 18*a* of the rear body 18, with the stem 26*a* extending well into the chamber 28*b* of the stem cap 28 and with the ram body head 26*e* being in close proximity to the plate 16 of the pressure plate C. Furthermore, a fluid passageway 16*d* is formed in the plate 16 to permit fluid communication between end surface 16*c* and first end 20*b* of the piston sleeve 20 while fluid passageway 18*d* is formed in the rear body 18 to permit fluid communication between the piston sleeve chamber 18*a* of the rear body 18 and the piston sleeve chamber 18*e* formed in rear body 18 and piston sleeve chamber 22*a* formed in piston housing 22. While for the purposes of explanation, the actuated and retracted positions are shown in FIGS. 5A, 5B, respectively, it should be understood that action of the blowout preventer B results in both actuating rods 26 simultaneously being either actuated or simultaneously being retracted in response to fluid pressure, as will be discussed more fully hereinbelow.

Figure 4:
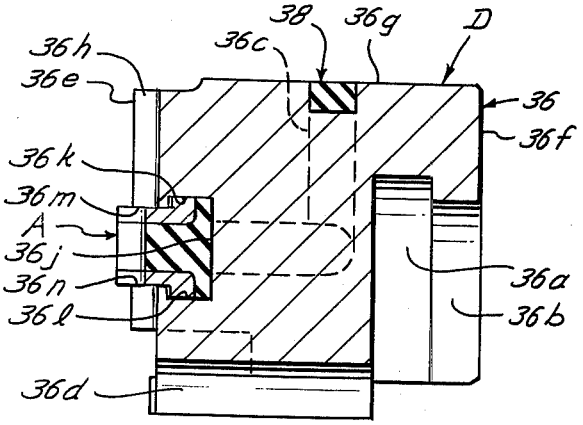
FIG. 4 is a side, elevational view of the ram body of FIG. 3, taken along the lines 4—4 of FIG. 3.

The ram body D includes ram 36 formed having body head receptacle 36*a* (FIG. 4) for receiving the ram body head 26*e* of the actuating rod 26 therein with a portion 26*h* of the rod 26*d* being received in rod receptacle 36*b* of the ram 36. Preferably, the ram body D is of a generally cylindrical configuration and is formed having an outer seal groove for receiving outer seal 38 therein for suitable sealing action between the ram 36 and ram bore 10*o* of the body 10, the ram 36 adapted to be disposed within the preventer body P. A suitable guide opening 36*d* is preferably formed with the lower end of the ram 36 and is adapted to receive a suitable key or the like (not shown) within the ram bore 10*o* for insuring proper orientation of the ram 36 with respect to the body 10 when fully assembled and during movement of the ram 36 between the actuated and retracted positions. The ram 36 is further formed having a front surface 36*e*, a rear surface 36*f*, and an outer annular surface 36*g*. Preferably the front surface 36*e* is formed having semicircular detent 36*h* that is of such a diameter that is slightly larger than the tubular members (not shown) that are to be sealed against upon actuation of the blowout preventer B. The inner seal assembly A of the present invention is adapted to be mounted with the ram body D by mounting such in the inner seal opening 36*i* formed in the ram 36. The inner seal opening 36*i* includes a rear surface 36*j*, an upper surface 36*k*, a lower surface 361, an upper stepped surface 36*n* and a lower stepped surface 36*n*. As such, the inner seal opening 36*i*, as viewed in FIGS. 4, 7B is somewhat of a generally "T-shaped" configuration for receiving the inner seal assembly A of the present invention as discussed more fully hereinbelow.

Figure 6:
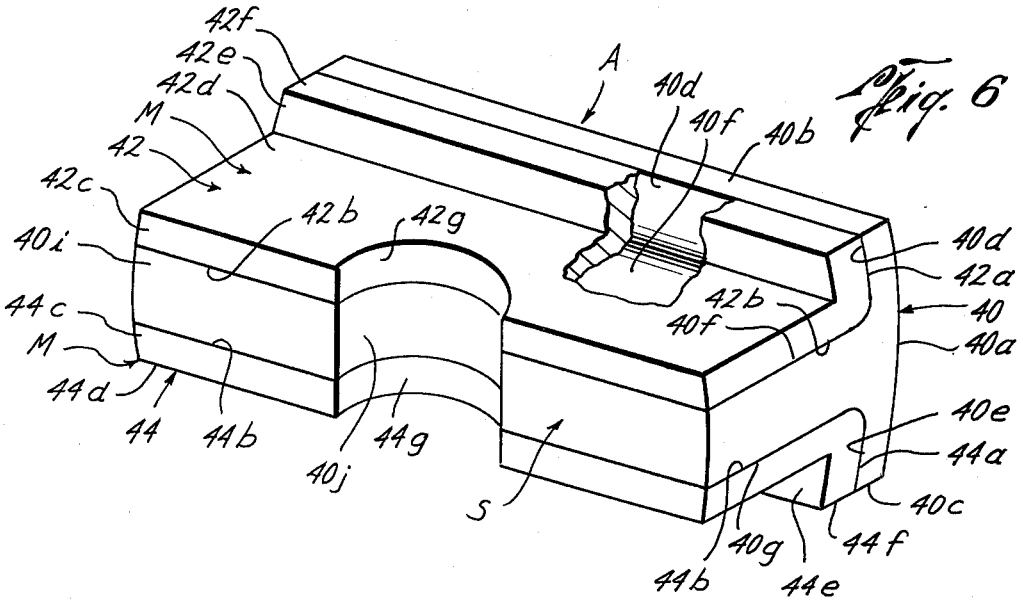
FIG. 6 is an isometric, enlarged view of the inner seal assembly of the present invention; and, FIGS. 7A and 7B compare the inner seal assembly of the present invention with that of the prior art inner seal assemblies.

The inner seal assembly A of the present invention includes resilient sealing material S and mounting plates M as best seen in FIG. 6. It is preferred that the inner seal assembly A be symmetrically formed about the horizontal plane such that in a side elevational view as shown in FIG. 4, the upper half of the inner seal assembly A is identical with the lower half thereof except they are merely mirror images. As shown in FIG. 6, the inner seal assembly A is formed of a resilient sealing material S which includes sealing material 40, which may include rubber, or multiple composites thereof or any other suitable resilient material. Preferably the sealing material 40 is formed having a ram body engaging surface 40*a*, an upper ram seal bore engaging surface 40*b*, a lower ram seal bore engaging surface 40*c*, an upper mounting plate foot engaging surface 40*d*, a lower mounting plate foot engaging surface 40*e*, an upper mounting plate engaging surface 40*f*, lower mounting plate engaging surface 40*g*, inner bore surface 40*i* and inner seal surface 40*j*. As such, the ram body engaging surface 40*a* is adapted to abut the rear surface 36*j* of the inner seal opening 36*i* in ram 36. Preferably, the upper and lower ram seal bore engaging surfaces 40*b*, 40*c* are substantially perpendicular to the ram body engaging surface 40*a*. Preferably, the upper and lower mounting plate foot engaging surfaces 40*d*, 40*e* are substantially perpendicular to the upper and lower ram seal bore engaging surfaces 40*b*, 40*c*, respectively. Furthermore, preferably upper and lower mounting plate engaging surfaces 40*f*, 40*g* are substantially perpendicular to the upper and lower mount plate foot engaging surfaces 40*d*, 40*e*, respectively. Inner bore surfaces 40*i* and inner seal surfaces 40*j* are substantially perpendicular to and join the upper and lower mounting plate engaging surfaces 40*f*, 40*g*. As such, though somewhat out of scale as shown in FIG. 6, the sealing material 40 of the resilient sealing material S of the inner seal assembly A is somewhat of a "T-shaped" configuration as viewed in side elevational cross-section.

Mounting plates M are adapted to be secured with the resilient sealing material S preferably by molding therefore together or any other suitable joining process. Preferably the mounting plates M include an upper mounting plate 42 and a lower mounting plate 44. The upper and lower mounting plates 42, 44 include inner foot surfaces 42*a*, 44*a*, inner seal engaging surfaces 42*b*, 44*b*, inner bore surfaces, 42*c*, 44*c*, outer ram engaging surfaces 42*d*, 44*d*, outer foot surfaces 42*e*, 44*e*, and, ram body foot surfaces 42*f*, 44*f*, respectively. As such, the inner foot surfaces 42*a*, 44*a* of the upper and lower mounting plates 42, 44, respectively are adapted to engage upper and lower mounting plate foot engaging surfaces 40*d*, 40*e*, respectively. Inner seal engaging surfaces 42*b*, 44*b* engage upper and lower mounting plate engaging surfaces 40*f*, 40*g*, with inner bore surfaces 42*c*, 44*c* in substantial vertical alignment with inner bore surface 40*i*. Thus, the inner foot surfaces 42*a*, 44*a* are substantially perpendicular with the inner seal engaging surfaces 42*b*, 44*b*, respectively, while the outer ram engaging surfaces 42*d*, 44*d* substantially parallel the inner seal engaging surfaces 42*b*, 44*b*, and the outer foot surfaces 42*e*, 44*e* substantially parallel the inner foot surfaces 42*a*, 44*a*. Ram body foot surfaces 42*f*, 44*f* are in substantial horizontal alignment with the upper and lower ram seal bore engaging surfaces 40*b*, 40*c*. Inner seal surfaces 42*g*, 44*g* are in substantial alignment with inner seal surface 40*j* of the sealing materials, which conforms substantially to that of the outer annular surface of the tubular member (not shown) adapted to be disposed in the central bore 10*c*. Thus, in side elevational cross-section, the upper mounting plate and lower mounting plate 44 are substantially of an "L-shaped" configuration. As such, the overall "T-shaped" inner seal assembly A is adapted to be mounted within the "T-shaped" inner seal opening 36*i* of the ram 36 of the ram body D.

Figure 2:
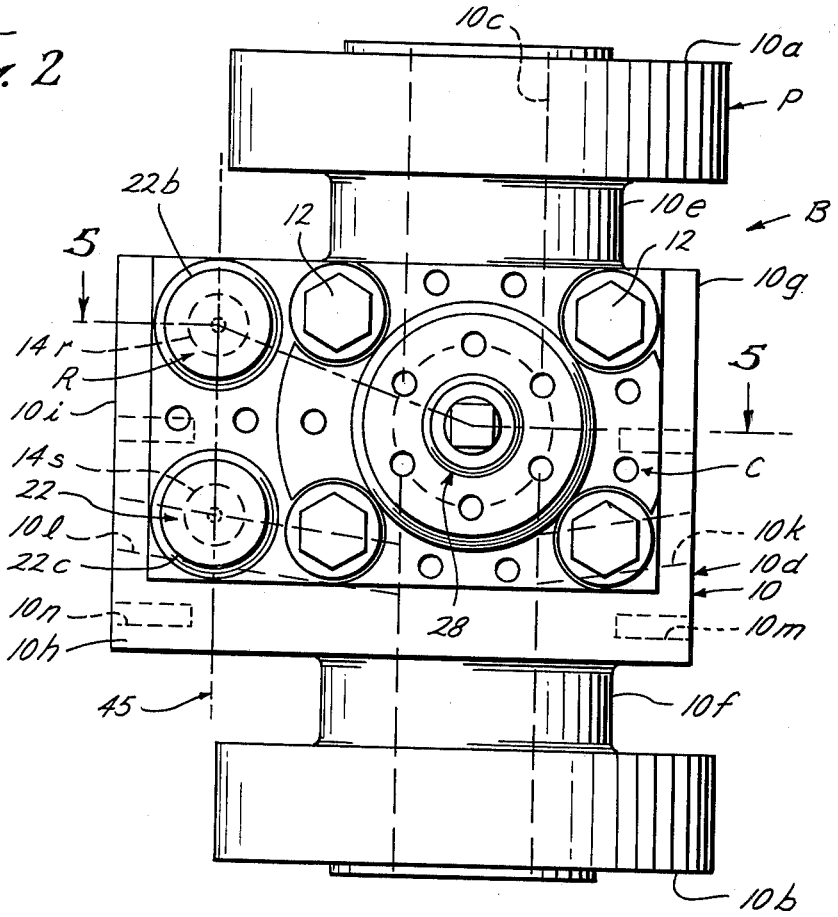
FIG. 2 is an elevational view of the blowout preventer incorporating the inner seal assembly and support rod assembly of the present invention.
Figure 3:
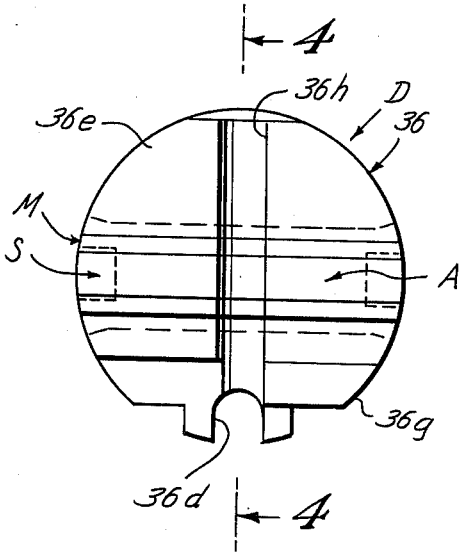
FIG. 3 is a front, elevational view of the ram body of the blowout preventer, showing a front, elevational view of the inner seal assembly of the present invention.

The support rod assembly R of the present invention includes the piston rods 14, the piston sleeves 20 and their respective piston housings 22. The piston housings 22 include housings 22*b*, 22*c* on side 10*h* and housing 22*d*, 22*e* on side 10*j*. Housings 22*b*, 22*d* and 22*c*, 22*e* are adapted to be in substantially a horizontally opposed, axially aligned relationship with the blowout preventer B. As best illustrated in FIGS. 1 and 2, each of the two plate 16-rear body 18 assemblies as affixed to sides 10*h*, 10*j* of the body 10 of the preventer body P have a pair of support rod assemblies R mounted to one side of the actuating rod 26-ram body D assemblies. Preferably the support rod assemblies R of each side 10*h*, 10*j* are in substantially aligned axial relationships with its opposing member, however with the longitudinal axis of each of the rod assemblies R of one side of the blowout preventer B being situated in a substantially vertical plane. Thus the longitudinal axis of housings 22*b* and 22*c* of the rod assemblies R are substantially parallel and lie in a substantially vertical plane 45 (FIG. 2) as do housings 22*d*, 22*e* of side 10*j* of the body 10.

In the use or operation of the blowout preventer B, it is typical that such a blowout preventer B be used in combination with multiple blowout preventers B to form a stack of blowout preventers. As such the multiple blowout preventers are affixed with one another by means of upper and lower flanges 10*a*, 10*b* of the body 10 such that all central bores 10*c* of the blowout preventers B are in axial alignment with one another so that suitable tubular member (not shown) may be disposed within the central bore 10*c* of the blowout preventer B. As best seen in FIG. 5B, the blowout preventer B is initially positioned with the actuating rod 26 and ram 36 in a retracted position. In this retracted position, the piston surface 26*b* of the actuating rod 26 engages end surface 18*c* of rear body 18 and the rear surface 36*f* of the ram 36 is adapted to engage the pressure plate 16 as the ram 36 is disposed within the ram bore 10*o*, yet leaving the central bore 10*c* unrestricted to permit the disposition of tubular members (not shown) therein. Fluid pressure in passageway 16*d* ensures this retracted positioning of the ram body D and actuating rod 26. When it is desired to actuate the blowout preventer B for sealing with the tubular member within the central bore 10*c*, fluid pressure flows through passageway 10*r* formed within the preventer body P, thereinto the central bore 14*c* of the piston rod 14 thereinto chamber 46 formed between piston sleeve chamber 22*a* of piston housing 22 and the piston sleeve 20, thereinto passageway 18*d* into chamber 48 formed between the piston sleeve 24 and piston sleeve chamber 18*a* of the rear body 18 for reacting thereafter upon piston surface 26*b* of the actuating rod 26. Fluid pressure upon the piston surface 26b results in the actuating rod 26 moving upwardly as viewed in FIG. 5B to force the ram body D towards the central bore 10c of the body 10. Simultaneously, the opposing ram body D accomplishes the same result such that both ram bodies D close in response to the same fluid pressure during their respective engagement with the tubular member within the central bore 10c of the body 10. Because of commonality of passageways 10r, 14c, chambers 46, passageway 18d and the like, fluid pressure is balanced such that both opposing ram bodies D engage the tubular member substantially at the same time to in effect seal the annulus between the tubular member and the central bore 10c of the body by sealable engagement of the inner seal assembly A with the opposing inner seal assembly A and engagement with the tubular member.

It should be appreciated that by the appropriate engagement of the tool engaging surface 30b of the stem lock 30 and the attendant rotation thereof, results in the stem receiver 30c engaging the stem end 26g to effectuate a mechanical closure of the ram body D by forcing such into the central bore 10c for appropriate sealing operations. This procedure may also be accomplished after the blowout preventer B has been hydraulically actuated and the ram body D is already actuated, yet the stem lock 30 will provide a mechanical assurance that the ram bodies D will remain closed. When it is desired to release the sealing pressure acting upon the ram body B, the stem lock 30 may merely be unthreaded and the fluid pressure introduced into fluid passageway 16d to permit retraction of the ram body D and actuating rod 26 from the central bore 10c of the preventer body P, as desired.

As best depicted in FIG. 7B, upon the ram bodies B closing, the inner bore surfaces 42c, 44c as well as inner bore surface 40i engage one another in full face contact between the opposing inner seal assemblies A. As pressure is increased upon the ram body D, the inner seal assembly A experiences such pressure as being exerted through the rear surface 36j of the inner seal opening 36i in the ram 36. An increase in the closing force acting in the direction of arrows 50 in FIG. 7B results in a relative movement of the inner seal assembly A with respect to that of ram body D in the direction of arrows 52. This results not only from the closing force in the direction of arrows 50 but the resultant reactive force of the opposing inner seal assemblies A having full face contact along inner bore surfaces 42c, 44c, 40i and 42g, 44g, 40j. As the inner seal assemblies A react in the direction of arrows 52, the resilient sealing material S tends to flow in the direction of arrows 54, from that portion of the "L-shaped" mounting plates M towards the central bore 10c for enhanced sealing action in the same direction 50 of the closing force.

Figure 7A:
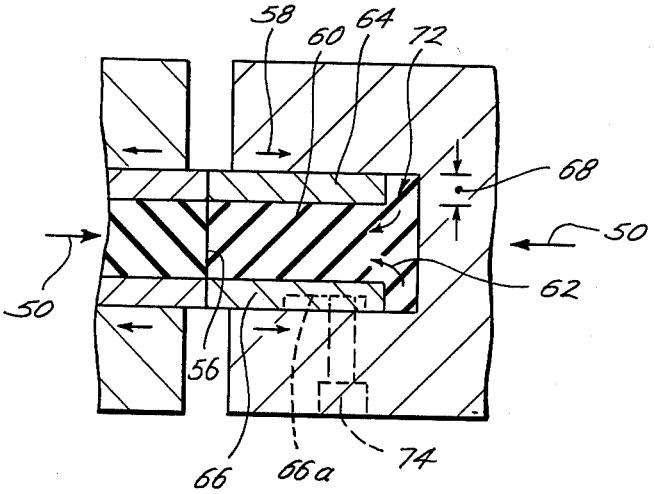
Fig. 7A PRIOR ART
Figure 7B:
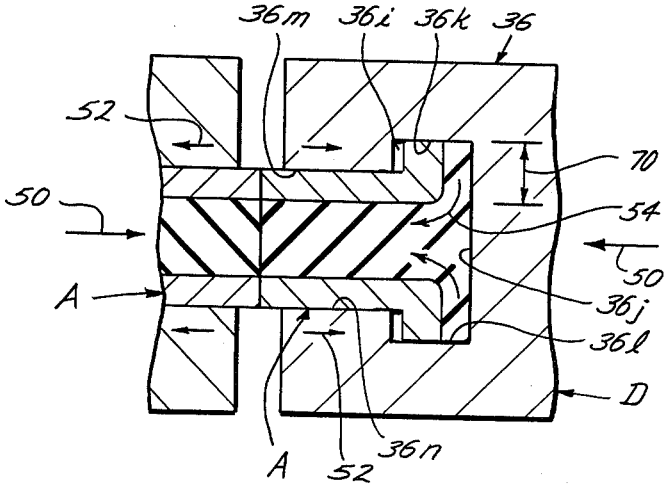

Prior art seals, such as that shown in FIG. 7A have historically had a generally rectangular cross-sectional, side elevational configuration, such that in response to a closing force 50 acting upon a ram body, the prior art inner seal assemblies 72 would engage one another upon a substantially full face surface contact as on surface 56. This surface 56 contact would result in a reactive force acting in the direction of arrows 58 which would tend to flow the resilient sealing material 60 of the seal assembly 72 in the direction of arrows 62 in response to the mounting plates 64, 66 of the prior art seal assembly 72 moving in the direction of arrows 58. However, the prior art seal assemblies 72 were responsive to flow of resilient sealing material 60 due only to the limited surface area contact depicted by the dimensional arrow 68 between the mounting plates such as 64 and the resilient material 60. By utilization of the inner seal assembly A of the present invention, the area of contact as demonstrated by dimensional thickness 70 due to the "T-shaped" configuration of the overall inner seal assembly A, including not only the "T-shaped" resilient sealing material S but also the "L-shaped" mounting plates M, results in an increased area of contact pressure thus resulting a greater amount of "flow" of the resilient sealing material S upon closure of the ram body D for enhancing high pressure sealing. This area of contact pressure is defined by the height 70 multiplied by the overall width of the inner seal assembly A. Thus the ratio of the areas of the prior art seal 72 to the seal assembly A of the present invention is defined by a comparison of the thickness 68 to that of height 70, with that of 70 defining a significantly greater amount to enhance sealing action. Seals such as this must be capable of operation under pressures up to twenty thousand pounds per square inch without failure in order to function as intended. Thus, by using the inner seal assembly A of the present invention, an improved high pressure sealing is effectuated upon closure of the ram body D upon actuation of the blowout preventer B.

However, due to the high pressures typically encountered in such a blowout preventer B, it is necessary that the inner seal assembly A be positioned for ease of replacement and maintenance. Heretofore, as shown in FIG. 7A, typically a prior art seal assembly 72 is secured with the ram body by means of a suitable fastener 74 which extends through the ram body, into slot 66a formed in the mounting plate 66. Thus, in order to remove such a prior art seal assembly 72, the blowout preventer B must be partially disassembled in such a fashion that not only access may be easily had to the seal assembly 72 but also to the fastener 74 to result in maintenance and/or removal of the seal assembly 72.

Prior art rod assemblies are typically positioned in the same horizontal plane as that of the ram body-actuating rod assembly and on both sides of this ram body-actuating rod assembly. As such, inner seal removal had to be accomplished by removal thereof along the longitudinal axis of the actuating rod (if the ram body was not removed) or removal of the ram body entirely from the blowout preventer was necessary prior to seal replacement.

By utilizing the support rod assembly R with the blowout preventer B of the present invention, seal maintenance and removal operation is significantly improved, particularly in the instance where multiple, stacked blowout preventers B are utilized. As best seen in FIG. 5A when it is determined that there is a need to replace the inner seal assembly A of the present invention, the pressure plate blots 12 are removed from the threaded openings 10p, plate 16 and rear body 18. Thereafter, fluid pressure is introduced into passageway 10r and flows through central bore 14c of the piston rod 14. However, inasmuch as there are no pressure plate bolts 12 to restrain movement of the plate 16 and rear body 18 with respect to body 10, the pressure acting in chamber 46, passageway 18d and down to piston surface 26c is allowed to build, then backs up to react upon piston end 14b of the piston rod 14 to apply a fluid pressure buildup within the chamber 46. As a result, the plate 16 and rear body 18 move outwardly with respect to the body 10 to result in an extraction of the ram body D from the preventer body P, with the support rod assembly R supporting the entire pressure plate C, rear body 18, actuating rod 26, ram body D assembly as shown expanded in FIG. 5A and FIG. 1. In this fully expanded position, the inner seal assembly A of the present invention may be removed by merely tapping the inner seal assembly A laterally such that the seal slides laterally within the inner seal opening **36*i* formed in the ram 36 of the ram body D. As such, the seal may be slid laterally between the piston rods 14*r*, 14*s* as shown in FIG. 1 or may alternatively by appropriate placement of a tool (not shown) between the vertically spaced piston rods 14, permit removal of the inner seal assembly A in the opposite lateral direction. Due to the "T-shaped" configuration of the inner seal assembly A of the present invention and the compatible opening 36*i* in ram 36, no external fasteners such as fasteners 74 (FIG. 7A) are required to be removed, which typically pose extreme difficulties for removal when multiple blowout preventers B are stacked upon one another. Furthermore, the ram body D need not be removed from the actuating rod 26 in order to accomplish the seal removal and replacement operation. Thus, the "T-shaped" inner seal opening 36*i* and "T-shaped" inner seal assembly A requires no additional fasteners to secure and properly position the inner seal assembly A with the ram body D. By using the inner seal assembly A of the present invention, the pressure plate bolts 12 need merely be removed and appropriate pressure applied to extract the ram body D from the preventer body P whereinafter the fully exposed ram body D may have the inner seal assembly A easily removed and extracted therefrom and be replaced with a new inner seal assembly A merely by forcing the seal laterally to and from the ram body D. The orientation of the support rod assembly R in the substantially vertical plane 45 (FIG. 2) with the actuation thereof paralleling the axis of the actuating rod 26** and ram body D, permits the ease of laterally replacing and maintencing the inner seal assembly A.

Thus, the inner seal assembly A and support rod assembly R as used with a high pressure blowout preventer B provides for enhanced sealing action upon actuation of the blowout preventer B yet providing an inner seal assembly A capable of being easiliy maintained and replaced by field service personnel.

The foregoing disclosure and description of the invention are illustrative and explanatory thereof, and various changes in the size, shape and materials, as well as in the details of the illustrated construction may be made without departing from the spirit of the invention.

We claim:

1. An inner seal assembly for removably mounting within an inner seal opening formed in a ram body of a blowout preventer having a ram bore, comprising:

a resilient sealing material adapted to be mounted with the ram body, said resilient sealing material formed having a ram body engaging surface, upper and lower ram seal bore engaging surfaces, upper and lower mounting plate foot engaging surfaces, upper and lower mounting plate engaging surfaces, and an inner seal surface, wherein, said upper and lower ram seal bore engaging surfaces are substantially perpendicular to said ram body engaging surface, said upper and lower mounting plate foot engaging surfaces are substantially perpendicular to said upper and lower ram seal bore engaging surfaces, respectively, said upper and lower mounting plate engaging surfaces are substantially perpendicular to said upper and lower mounting plate foot engaging surfaces, respectively, and, said inner seal surface is substantially perpendicular to said upper and lower mounting plate engaging surfaces;

upper and lower mounting plates with said resilient sealing material, said upper and lower mounting plates each formed having an inner foot surface, an inner seal engaging surface, an inner bore surface, an outer ram engaging surface, an outer foot surface, and a ram body foot surface, wherein said inner foot surfaces of said upper and lower mounting plates are substantially parallel with said ram body engaging surface and with said upper and lower mounting plate foot engaging surfaces, respectively, said inner seal engaging surfaces of said upper and lower mounting plates are substantially perpendicular to said inner foot surfaces of said upper and lower mounting plates and with said upper and lower mounting plate engaging surfaces, respectively, and said ram body foot surfaces, said outer foot surfaces, and said outer ram engaging surfaces of said upper and lower mounting plates are mountable within the inner seal opening of the ram body, said resilient sealing material and said upper and lower mounting plates are adapted to be retained by the inner seal opening for sealable movement in a direction parallel to the longitudinal axis of the ram body, said resilient sealing material and said upper and lower mounting plates are removably mounted with the inner seal opening in a direction perpendicular to the longitudinal axis of the ram body solely by the exertion of a lateral force on said resilient sealing material and said upper and lower mounting plates when the ram body, said resilient sealing material, and said upper and lower mounting plates are retracted from the ram bore; and, said upper and lower mounting plates enhancing flow of said resilient sealing material upon sealing actuation of the ram body of the blowout preventer.

2. The inner seal assembly of claim 1, wherein:

said upper and lower ram seal bore engaging surfaces of said resilient sealing material are in alignment with said ram body foot surfaces of said upper and lower mounting plates, respectively.

3. The inner seal assembly of claim 1, wherein:

said upper and lower mounting plates are of a "L-shaped" configuration in elevational, side cross-section.

4. The inner seal assembly of claim 3, wherein:

said resilient sealing material is of a substantially "T-shaped" configuration in elevational, side cross-section.

5. The inner seal assembly of claim 1, wherein the inner seal opening formed in the ram body includes an upper surface, a lower surface, and a rear surface, wherein:

said ram body engaging surface is in substantial full-faced contact with the rear surface of the inner seal opening in the ram body; and, said upper and lower ram seal bore engaging surfaces of said resilient sealing material and said upper and lower ram body foot surfaces of said upper and lower mounting plates, respectively, are in partial engagement with the upper surface and lower surface, respectively, of the inner seal opening.

6. The inner seal assembly of claim 5, wherein the inner seal opening in the ram body further includes upper and lower stepped surfaces adjacent the upper and lower surfaces of the inner seal opening, respectively, wherein:

said upper and lower outer ram engaging surfaces of said upper and lower mounting plates, engage the upper and lower stepped surfaces of the inner seal opening, respectively.

7. The inner seal assembly of claim 1, wherein the blowout preventer has a preventer body, a pressure plate adapted to be secured with the preventer body and support rods for supporting the pressure plate upon removal of the pressure plate from the preventer body during seal removal operations, wherein:

the support rods are mounted with the preventer body and the pressure plate in a vertical plane substantially parallel with the actuating axis of the ram body of the blowout preventer, with the upper and lower support rods being vertically separated a height greater than the thickness between said upper and lower ram body foot surfaces of said upper and lower mounting plates to permit the lateral extraction of said resilient sealing material having said upper and lower mounting plates therewith between the upper and lower support rods for enhanced seal removal operations.

8. In a blowout preventer, having a preventer body, the preventer body formed having a ram bore for receiving a ram body, and a pressure plate removably mounted with the preventer body, an inner seal and support rod assembly comprising:

upper and lower support rods mounted in a vertical plane, with said vertical plane being substantially parallel with the vertical bore of the blowout preventer;

the longitudinal axis of both said upper and lower support rods being substantially horizontally disposed in said vertical plane;

an inner seal assembly adapted to be removably mounted with the ram body, the ram body being formed having a "T-shaped" inner seal opening therein for receiving said inner seal assembly;

said inner seal assembly being formed of a substantially "T-shaped" configuration to be received within said "T-shaped" inner seal opening formed in the ram body, thereby retaining said inner seal assembly to the ram body in a direction parallel to the longitudinal axis of the ram body; and, said inner seal assembly being removably mounted by lateral displacement thereof from the ram body solely by the application of a lateral force to said inner seal assembly when the ram body and said inner seal assembly is retracted from the ram bore.

9. The inner seal and support rod assembly of claim 8, wherein:

said lateral displacement of said inner seal assembly results in said inner seal assembly being removably disposed with the ram body in a plane extending between said upper and lower support rods for enhanced removal of said inner seal means.

10. The inner seal and support rod assembly of claim 8, wherein:

said upper and lower support rods are vertically separated a height greater than the thickness of said inner seal assembly to permit lateral displacement of said inner seal assembly between said upper and lower support rods for enhanced seal removal operations.

11. The inner seal and support rod assembly of claim 8, wherein said inner seal assembly further includes:

a resilient sealing material adapted to be mounted with the ram body, said resilient sealing material formed having a ram body engaging surface, upper and lower ram seal bore engaging surfaces, upper and lower mounting plate foot engaging surfaces, upper and lower mounting plate engaging surfaces, and an inner seal surface, wherein said upper and lower ram seal bore engaging surfaces are substantially perpendicular to said ram body engaging surface, said upper and lower mounting plate foot engaging surfaces are substantially perpendicular to said upper and lower ram seal bore engaging surfaces, respectively, said upper and lower mounting plate engaging surfaces are substantially perpendicular to said upper and lower mounting plate foot engaging surfaces, respectively, and, said inner seal surface is substantially perpendicular to said upper and lower mounting plate engaging surfaces;

upper and lower mounting plates with said resilient sealing material, said upper and lower mounting plates each formed having an inner foot surface, an inner seal engaging surface, an inner bore surface, an outer ram engaging surface, an outer foot surface, and a ram body foot surface, wherein said inner foot surfaces of said upper and lower mounting plates are substantially parallel with said ram body engaging surface and with said upper and lower mounting plate foot engaging surfaces, respectively, said inner seal engaging surfaces of said upper and lower mounting plates are substantially perpendicular to said inner foot surfaces of said upper and lower mounting plates and with said upper and lower mounting plate engaging surfaces, respectively, and, said ram body foot surfaces, said outer foot surfaces, and said outer ram engaging surfaces of said upper and lower mounting plates are mountable within the inner seal opening of the ram body; and, said upper and lower mounting plates enhancing flow of said resilient sealing material upon sealing actuation of the ram body of the blowout preventer.

12. The inner seal and support rod assembly of claim 11, wherein:

said upper and lower mounting plates are of a "L-shaped" configuration in elevational, side cross-section.

13. The inner seal and support rod assembly of claim 11, wherein:

said resilient sealing material is of a substantially "T-shaped" configuration in elevational, side cross-section.

* * * * *